United States Patent [19]

Chaussadas

[11] Patent Number: 4,703,856

[45] Date of Patent: Nov. 3, 1987

[54] MULTIPACK FOR FLANGED PRIMARY CONTAINERS

[75] Inventor: Jean Chaussadas, Brassioux, France

[73] Assignee: The Mead Corporation, Dayton, Ohio

[21] Appl. No.: 47,375

[22] Filed: May 7, 1987

[30] Foreign Application Priority Data

May 8, 1986 [GB] United Kingdom ..... 8611226

[51] Int. Cl.[4] ..... B65D 71/00

[52] U.S. Cl. ..... 206/429; 206/151; 206/431; 206/434; 206/485; 229/40

[58] Field of Search ..... 206/151, 158, 427, 431, 206/434, 485, 499, 161, 429; 229/40

[56] References Cited

U.S. PATENT DOCUMENTS

| | | | |
|---|---|---|---|
| 3,123,214 | 3/1964 | McReynolds, Jr. | 206/434 |
| 3,157,347 | 11/1964 | Higgs et al. | 229/40 |
| 3,166,190 | 1/1965 | Conrades | 229/40 |
| 4,164,286 | 8/1979 | Sutherland | 229/40 |
| 4,489,880 | 12/1984 | Calvert | 229/40 |

FOREIGN PATENT DOCUMENTS

| | | | |
|---|---|---|---|
| 2807184 | 8/1978 | Fed. Rep. of Germany | 229/40 |
| 1055224 | 1/1967 | United Kingdom | 229/40 |

*Primary Examiner*—Jimmy G. Foster
*Attorney, Agent, or Firm*—Erwin Doerr

[57] ABSTRACT

A package accommodating a group of flanged containers (C1–C4) includes two rows of containers in which portions of top flanges (f) of the containers (C1, C2) in one row are overlapped with portions of the top flanges of the containers (C3, C4) in the second row. The package includes a top panel having a locking tab (34) which is engaged beneath the top flanges of the containers in the second row.

5 Claims, 6 Drawing Figures

MULTIPACK FOR FLANGED PRIMARY CONTAINERS

This invention relates to a package which accommodates a plurality of primary containers arranged in two or more rows. The package is particularly useful for grouping together and supporting a number of containers such as sealed plastics cups having a top flange and which contain foodstuff such as yogurt or other dairy produce.

The present invention provides a package for accommodating a plurality of flanged containers which comprises a top panel and a base panel interconnected by spaced side wall thereby providing a tubular structure in which said containers are received, said base panel being formed with a plurality of apertures into each of which a respective one of the containers is inserted such that a lower portion of each container protrudes beyond said base panel externally of the package and such that said top panel overlies the top of said containers, characterised in that said top panel includes locking means which is inserted into a gap formed between adjacent portions of top flanges of adjacent rows of containers and has portions located beneath the flanges of an adjacent pair of said containers to restrict movement of the upper portions of those containers relative to the top panel.

According to a feature of the invention, the locking means may comprise a locking tab which protudes from a marginal edge of one portion of said top panel which is hinged to a second portion of said top panel. Preferably, the hinged connection between said portions of the top panel extends across said top panel substantially centrally thereof.

According to yet another feature of the invention, the containers may be arranged in two parallel rows and portions of said top flanges of the containers in one row may be overlapped over portions of said top flanges of the containers in the other row. In constructions where this feature is adopted said locking tab may have portions located beneath the flanges of the containers in said other row. Preferably, free corner portions of said locking tab are located beneath the flanges of the containers in said other row.

An embodiment of the invention will now be described, by way of example, with reference to the accompanying drawings, in which.

Figure 1:
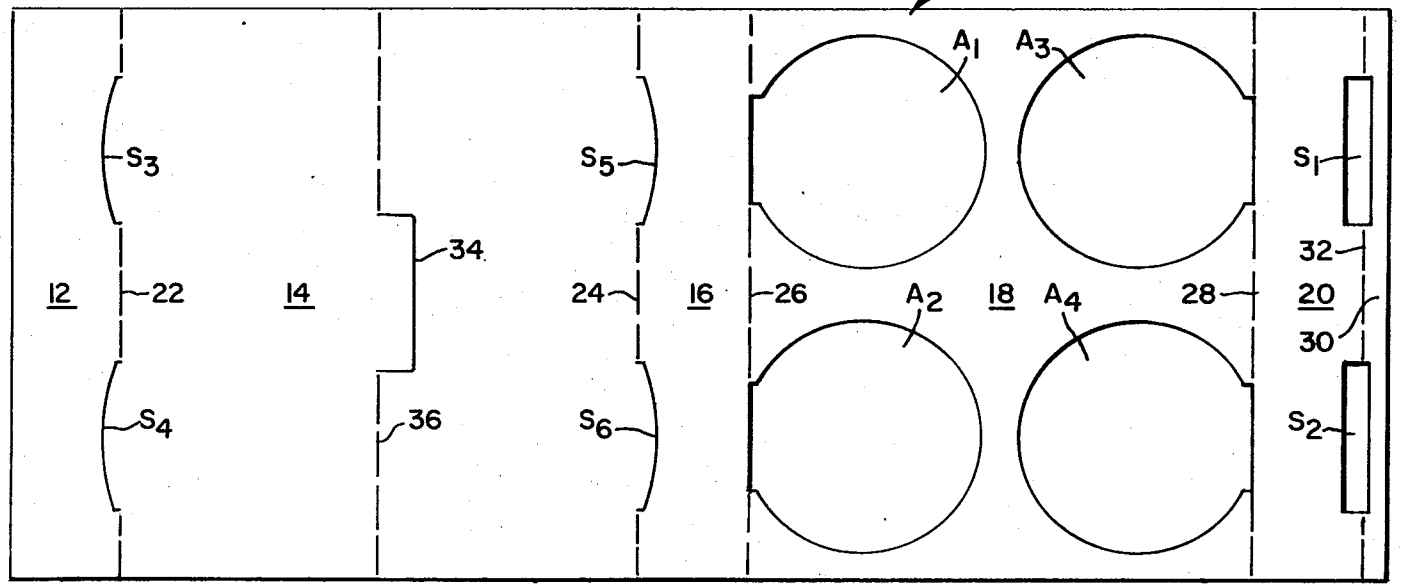
FIG. 1 is a plan view of a blank from which a package according to the invention is made.

Referring first to FIG. 1, an elongate blank 10 of paperboard or like foldable sheet material comprises, in series, a first outer side wall panel 12, a top panel 14, a second side wall panel 16, a base panel 18 and a first inner side wall panel 20 hinged one to the next along transverse fold line 22, 24, 26 and 28 respectively.

Figure 2:
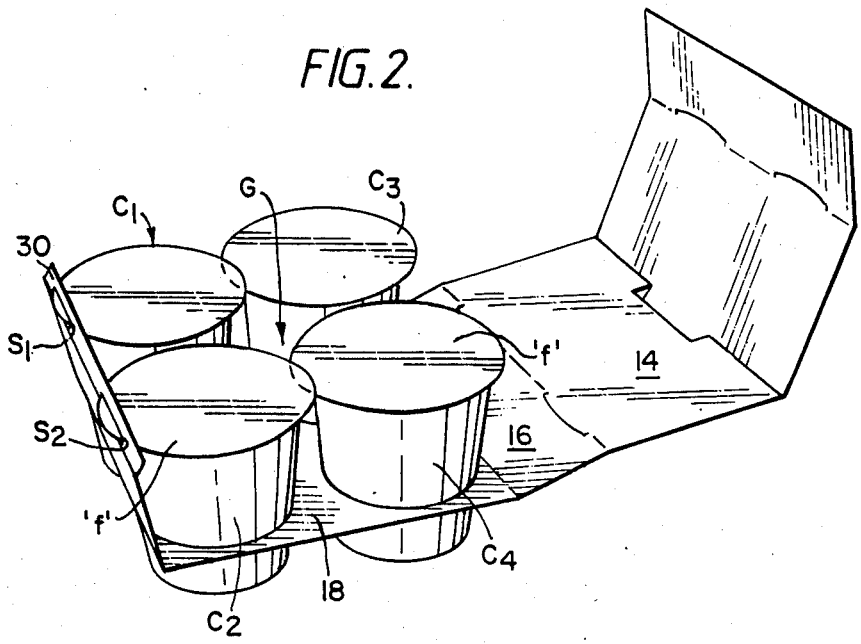
FIG. 2 is a perspective view of the partially formed package showing the relative dispositions of four primary containers.

The base panel is formed with a set of four substantially circular apertures each to receive one of the primary containers to be packaged. As best seen in FIG. 2, the containers C1–C4 have inverted fustroconical body portions and the base panel apertures are sized to hold the containers at a location intermediate the tops and bottoms of the containers so that a lower part of each container extends externally of the package beneath the base panel. The first inner side wall panel has an auxilliary panel 30 hinged thereto along transverse fold line 32. Between the first inner side wall and the auxiliary panel a pair of flange retaining slots S1, S2 are struck along fold line 32 to receive a peripheral portion of the top flange 'f' of containers C1 and C2 respectively when the auxilliary panel is folded into overlapping relationship with the lids of containers C1 and C2.

Likewise, flange retaining slots S3, S4 are struck in the outer first side wall panel 12 and further flange retaining slots S5, S6 are struck from second side wall panel 16. When the second side wall panel 16 is brought into flanking relationship with upper portions of containers C3 and C4, the flange retaining slots S5 and S6 receive peripheral portions of the top flanges of containers C3 and C4.

Figure 3:
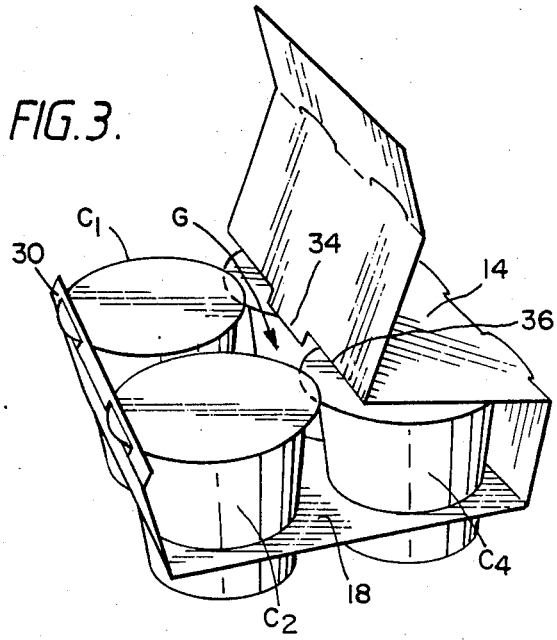
FIGS. 3, 4 & 5 are perspective views of the partially formed package showing the top panel of the blank being locked into position relative to the group of containers.
Figure 4:
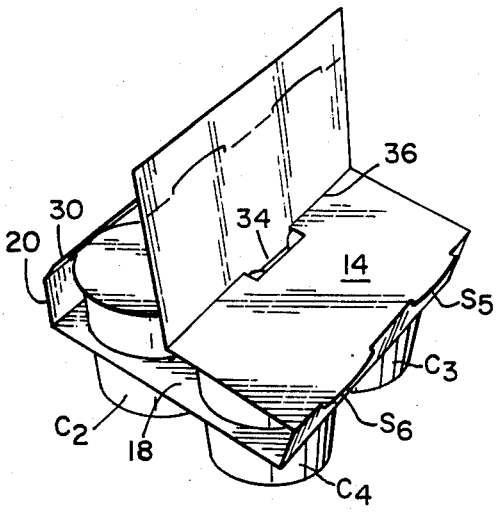
Figure 5:
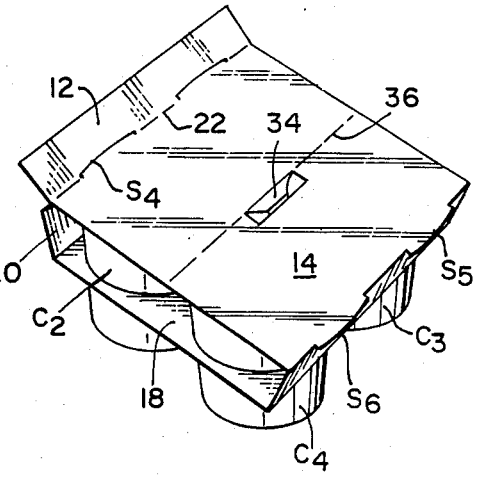
Figure 6:
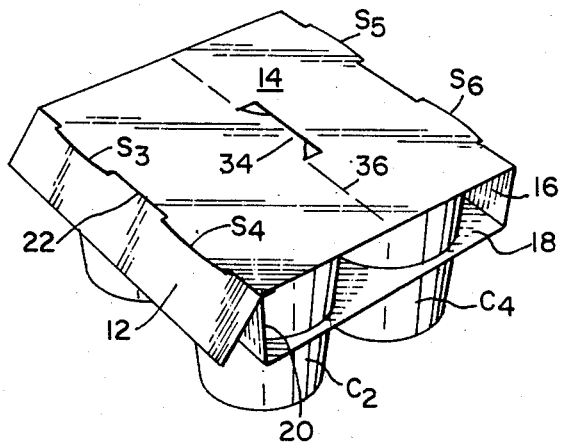
FIG. 6 is a perspective view of the virtually completed package.

The top panel 14 is folded relative to the second side wall panel so as to overlie the tops of the containers and is secured relative to the containers. In order to secure the top panel 12, a locking tab 34 is struck therefrom which protrudes and extends from a central transverse fold line 36. As best seen in FIGS. 3, 4 & 5, to engage the locking tab, a portion of the top panel is folded upwardly about the central fold line 36 and the locking tab 34 is inserted into the gap 'G' present between adjacent top flange portions of the group of containers C1–C4. Thereafter, the upward folded portion of the top panel is again folded about the central fold line 36 so that the whole of the top panel (with the exception of locking tab 34) lies in the same plane and lies atop the lids of the containers. This second folding of the top panel brings free corner portions of the locking tab 34 beneath the flanges of cups C3 and C4 and into engagement with the undersides of those flanges.

The flange retaining slots S3 and S4 are located in register with slots S1 and S2 and received like peripheral flange portions of containers C1 and C2 as the first outer side wall panel is secured in overlapping relationship with the first inner side wall in order thereby to complete the package.

It will be observed with reference to FIGS. 2 and 3 that peripheral portions of the top flanges of containers C1 and C2 are overlapped onto adjacent peripheral portions of the top flanges of containers C3 and C4. Apertures A1–A4 are spaced apart such that overlapping of the container top flanges can occur with appropriately sized containers.

The locking tab and the overlapped top flanges allow improvement of the package by minimizing the movement between the cups and the paperboard wrapper, thus providing a tighter wrap and hence a more secure package.

I claim:

1. A package accommodating a plurality of cylindrical containers having outwardly projecting flanges at the tops thereof and being arranged in two adjacent rows so that the flanges of the containers in one row overlap portions of the flanges of the containers in the other row, said package comprising a top panel and a base panel interconnected by spaced side walls thereby providing a tubular structure in which said containers are received, said top panel overlying the tops of said containers and being integral with one of said side walls and secured to the other of said side walls, characterised in that said top panel includes a locking means which extends inwardly and engages underneath the flanges of at least certain of said containers so as to restrict movement of the upper portions of the containers relative to the top panel.

2. The package according to claim 1, wherein said locking means engages underneath the flanges of containers in said other row.

3. The package according to claim 1, further characterised in that said top wall is divided by a central fold line and said locking means comprises a locking tab which interrupts said fold line and is defined by a U-shaped cut extending from said fold line into the adjacent portion of said top panel.

4. The package according to claim 1, further including means for retaining the lower portions of said containers.

5. The package according to claim 4, further characterised in that said retaining means comprises a plurality of spaced apertures formed in said base panel for receiving therethrough the lower portion of a respective one of said containers.

* * * * *